US006923899B2

(12) United States Patent
Brown et al.

(10) Patent No.: US 6,923,899 B2
(45) Date of Patent: Aug. 2, 2005

(54) LIMITING THE LOSS OF TIN THROUGH OXIDATION IN TIN OR TIN ALLOY ELECTROPLATING BATH SOLUTIONS

(75) Inventors: Neil D. Brown, Merrick, NY (US); Angelo Chirafisi, Howard Beach, NY (US); Peter R. Levey, Bellmore, NY (US)

(73) Assignee: Shipley Company, L.L.C., Marlborough, MA (US)

( * ) Notice: Subject to any disclaimer, the term of this patent is extended or adjusted under 35 U.S.C. 154(b) by 44 days.

(21) Appl. No.: 10/379,612

(22) Filed: Mar. 5, 2003

(65) Prior Publication Data

US 2003/0226759 A1 Dec. 11, 2003

Related U.S. Application Data

(60) Provisional application No. 60/361,858, filed on Mar. 5, 2002.

(51) Int. Cl.[7] ..... C25D 3/32

(52) U.S. Cl. ..... 205/253; 205/302

(58) Field of Search ..... 205/241, 253, 205/302; 106/1.22, 1.25

(56) References Cited

U.S. PATENT DOCUMENTS

| | | | | | |
|---|---|---|---|---|---|
| 3,749,649 | A | | 7/1973 | Valayil et al. | |
| 3,769,182 | A | | 10/1973 | Beckwith et al. | |
| 3,905,878 | A | | 9/1975 | Dohi et al. | |
| 4,118,289 | A | | 10/1978 | Hsu | |
| 4,582,576 | A | | 4/1986 | Opaskar et al. | |
| 4,994,155 | A | * | 2/1991 | Toben et al. | 205/140 |
| 5,066,367 | A | * | 11/1991 | Nobel et al. | 205/254 |
| 5,587,063 | A | * | 12/1996 | Kuhm et al. | 205/173 |
| 6,030,516 | A | * | 2/2000 | O'Driscoll | 205/302 |
| 6,562,221 | B2 | * | 5/2003 | Crotty | 205/254 |

FOREIGN PATENT DOCUMENTS

| | | |
|---|---|---|
| EP | 0 490 575 A2 | 6/1992 |
| JP | 1999-152595 A | 6/1999 |

* cited by examiner

*Primary Examiner*—Roy King
*Assistant Examiner*—William T. Leader
(74) *Attorney, Agent, or Firm*—John J. Piskorski

(57) ABSTRACT

Provided for is a solution for use in the electroplating of tin and tin alloys comprising a basis solution comprising an acid, optionally a salt thereof, the acid selected from the group consisting of fluoboric acid, an organic sulfonic acid, a mineral acid, or a combination thereof; divalent tin ions; and an antioxidant comprising a hydroxy benzene sulfonic acid or salt thereof, in an amount effective to prevent the oxidation of divalent tin ions. Also provided for is a method for electroplating comprising electroplating a substrate using an electroplating solution comprising a hydroxy benzene sulfonic acid or salt thereof in an amount effective to decrease the oxidation of tin ions.

14 Claims, No Drawings

LIMITING THE LOSS OF TIN THROUGH OXIDATION IN TIN OR TIN ALLOY ELECTROPLATING BATH SOLUTIONS

CROSS-REFERENCE TO RELATED APPLICATIONS

This application claims the benefit under 35 U.S.C. § 119(e) of U.S. Provisional Application No. 60/361,858, filed Mar. 5, 2002, the entire contents of which are incorporated herein by reference.

BACKGROUND OF THE INVENTION

Electroplating baths containing divalent tin and acids such as mineral acids (e.g., sulfuric acid, hydrochloric acid, and hydrofluoric acid), phenol-sulfonic acid, fluoboric acid, and methane sulfonic acid are used in plating tin and tin alloys. A problem is the loss of available divalent tin ($Sn^{2+}$) due to oxidation of the divalent tin to tetravalent tin ($Sn^{4+}$). Tetravalent tin accumulates as stannic acid and eventually forms an insoluble sludge in the bath. In addition to removing the amount of divalent tin available for plating, sludge formation also causes equipment fouling and plugging, resulting in an inferior product, along with increased operational costs.

Oxidation of divalent tin occurs at the anode of the electroplating cell, or can result from air introduced into the bath. For example, rapid pumping of plating solution required in the so called "high speed plating" processes result in the inclusion of substantial amounts of oxygen into the bath, which accelerates the oxidation of divalent tin. Accordingly, high-speed tin-plating worsens the sludge problem as compared to other non-high speed tin-plating applications. To prevent this oxidation and the corresponding formation of sludge, divalent tin should remain in solution, and/or be quickly converted back to divalent tin once oxidation has occurred.

Attempts to minimize divalent tin oxidation in plating baths are described, for example, in U.S. Pat. Nos. 5,094,726 and 5,066,367, both to Nobel et al., which are directed to using alkyl sulfonic-acid based tin solutions in combination with antioxidants (also referred to as reducing agents) to prevent a buildup of tetravalent tin. Specifically, Nobel et al. is directed to an electrolyte for electroplating tin or tin-lead alloys comprising a soluble divalent tin compound, a soluble alkyl or alkylol sulfonic acid in an amount sufficient to provide a solution having a pH less than 3, at least one wetting agent, and a hydroxyphenyl compound in an amount sufficient to reduce or prevent the formation of tetravalent tin and tin-oxide sludge. Hydroxyphenyl compounds include pyrocatecol, hydroquinone, resorcinol, phloroglucinol, pyrogallol, 3-amino phenol, or hydroquinone sulfuric acid ester.

However, reducing agents can be an incompatible with wetting agents, sulfonic acids, and other components of tin electroplating baths. These reducing agents react to form insoluble oils and gels, which have a detrimental effect on plating and result in an inferior product by coating heat-transfer surfaces, and/or forming emulsions within the cell. Anti-oxidants (reducing agents) that are compatible with the other components common in plating baths, and which prevent the oxidation of divalent tin and/or stabilize stannous tin to prevent sludge formation are desired.

SUMMARY OF THE INVENTION

In a first aspect of the present invention, there is provided a solution for use in the electroplating of tin and tin alloys comprising:

a basis solution comprising an acid, optionally a salt thereof, selected from the group consisting of fluoboric acid, an organic sulfonic acid, or a combination thereof;

divalent tin ions; and an antioxidant compound comprising a hydroxy benzene sulfonic acid or salt thereof, in an amount effective to reduce the oxidation divalent tin.

In a second aspect of the present invention, there is provided a method of electroplating tin and tin alloys comprising:

contacting a substrate with a solution comprising a basis solution comprising an acid, optionally a salt thereof, selected from the group consisting of fluoboric acid, an organic sulfonic acid, or a combination thereof;

divalent tin ions; and an antioxidant compound comprising a hydroxy benzene sulfonic acid or salt thereof, in an amount effective to reduce the oxidation divalent tin.

DETAILED DESCRIPTION OF THE INVENTION

It has been found that the addition of certain hydroxy benzene sulfonic acid or salts thereof, into divalent tin or tin alloy acid plating baths results in a substantially reduced rate of divalent tin oxidation. The use of the hydroxy benzene sulfonic acid, or salts thereof, does not result in the formation of insoluble oils, gels or other similar materials. This is particularly true in high speed plating situations, wherein operational conditions result in ambient oxygen being continuously introduced into the plating bath solution. The improvement resulting from the addition of hydroxy benzene sulfonic acid becomes especially significant when insoluble anodes are used at bath temperatures near or at the cloud point of the bath, wherein antioxidants are seen to react with other components in plating baths to form the insoluble oils and/or gels.

The hydroxy benzene sulfonic acid, or salt thereof is generally represented by Formula I:

Formula I

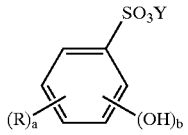

wherein Y is selected from the group consisting of H, alkali metal ions, alkaline earth metal ions, transition metal ions, and ammonium ions, wherein a is 0, 1, 2, or 3 (a=0, 1, 2, or 3), b is 1, 2, 3, 4, or 5 (b=1, 2, 3, 4, or 5), the sum of a and b is equal to 2, 3, 4, or 5 (a+b=2, 3, 4, or 5), and each R is independently selected from the group consisting of halogen, CN, COOY, $C_1$–$C_3$ alkyl, substituted $C_1$–$C_3$ alkyl, and $C_1$–$C_3$ alkoxy, wherein said alkyl substitutions are selected from the group consisting of straight chain or branched alkoxy, alkenyl, alkynyl, cycloalkyl, cycloalkenyl, acyl, phenyl, halosubstituted phenyl, heteroaryl, halogen, hydroxyl, cyano, or combinations comprising at least one of the foregoing. It will be appreciated by those skilled in the art that when the sum of a+b is less than 5, the remaining carbon atoms in the benzene ring are substituted with hydrogens. Preferably, the hydroxy benzene sulfonic acid, or salt thereof, is represented by Formula II:

Formula II

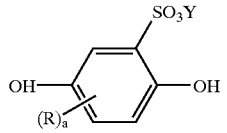

wherein a, R and Y are as define above. More preferably, a=0, and Y is a potassium ion ($K^+$).

Effective amounts of the hydroxy benzene sulfonic acid to suppress divalent tin oxidation (prevent sludge formation) may be readily determined by one of ordinary skill in the art, depending on factors such as bath composition, plating rate, temperature, and/or pH. In general, effective amounts of the hydroxy benzene sulfonic acid in the plating bath are greater than 0.1, preferably greater than 0.25, and more preferably great than 0.5 g/l. Effective amounts are generally less than 10, preferably less than 5, and more preferably less than 1 g/l.

The other components of the electroplating baths are generally known to one of ordinary skill in the art. These include suitable tin compounds, which are soluble in the basis solution. The desired alloying metals can be added in any form soluble in, or compatible with the basis solution, and include, for example, copper, bismuth, gold and silver. The metals are preferably added in the form of sulfonate and/or sulfonic acid salts.

The acids suitable for use include, but are not limited to, alkane sulfonic acids containing 1–7 carbon atoms including, for example, methane sulfonic acid, ethyl sulfonic acid; alkylol sulfonic acids containing 1–7 carbon atoms; aromatic sulfonic acids including, for example, phenol sulfonic acid, phenyl sulfonic acid; fluoboric acid; mineral acids including, for example, sulfuric acid, hydrochloric acid, and hydrofluoric acid; and combinations thereof. Methane sulfonic acid, phenol sulfonic acid, phenyl sulfonic acid, and fluoboric acid are most preferred. Salts or other derivatives of these acids can also be used, provided that the solution is sufficiently acidic and can retain all necessary components in solution. The pH range of these solutions will generally be less than 5, preferably less than 3.

A wide variety of surfactants are suitable for use in the electroplating solution containing the above described hydroxy benzene sulfonic acid, or salt thereof. When tin is electrodeposited using high speed electroplating processes and equipment, it is preferred to utilize substantially non-foaming wetting agents and/or surfactants. Typical surfactants of this type can be found in U.S. Pat. Nos. 4,880,507 and 4,994,155, both to Toben et al. Wetting agents or surfactants recited in U.S. Pat. No. 4,701,244 to Nobel et al. are also suitable for use herein. Surfactants having a cloud point higher than 33° C. are preferred. In addition, the plating solution can contain additives known to one skilled in the art to improve the performance of the electroplating process, the properties of the resulting electrodeposit, or other elements such as, for example, brighteners, leveling agents, bismuth compounds, acetaldehyde, or combinations comprising at least one of the foregoing.

Optimum amounts of wetting agents/surfactants and other additives will vary depending on the particular agent selected, the particular use, the particular bath conditions in which it is to be used, and other factors readily determined by one of skill in the art without undue experimentation. Generally, at least 0.05 ml/l, preferably at least 0.5 ml/l, more preferably at least 1 ml/l, and at most 10 ml/l, preferably at most 5 ml/l, more preferably at most 2 ml/l of the wetting agents give excellent results with pure tin and other tin alloys. Higher amounts of wetting agents and different combinations can be used, for example, when the concentration of the metal in the bath is increased.

The electroplating solution can be prepared by the combination, in any order of a tin compound, an acid, optionally a pH adjustment material, a wetting agent, and an antioxidant. The solution may require filtering depending on the order of addition, and diluting with water or other solvent to a final desired volume or component concentration. The electroplating solution is generally operated at temperatures at or above ambient (e.g., 20° C.), with agitation and elevated temperatures desirable for high-speed electroplating applications. Suitable solution temperature is readily ascertainable to one of skill in the art without undue experimentation. Typically electroplating is conducted at a temperature at least 15° C., and at most 66° C.

The bath may also be cooled or heated to maintain the desired temperature. When the electroplating step is conducted under high-speed conditions, the agitation and solution turnover due to pumping action maintains the oxygen content of the solution at or near its maximum concentration, thus promoting the tendency to oxidize tin (e.g., $Sn^{2+}$ to $Sn^{4+}$). Under these conditions, the use of the present antioxidants can maintain tin in its divalent state, i.e. as $Sn^{2+}$, while not interacting with other components in the solution to produce insoluble material including oils and/or emulsions.

Various alloys can be produced depending on the relative tin and alloying metal ratios employed in the solution. For example, plating a 60–40 tin-lead alloy, 20 g/l of tin metal and 10 g/l of lead metal can be used, as can 99-1 tin-copper, 98-2 tin-bismuth, 97-3 tin-silver, and combinations comprising at least one of the foregoing. Other ratios are routinely determined by one of skill in the art without undue experimentation.

EXAMPLES

Tests were conducted to evaluate the formation of insoluble materials, and to evaluate the effectiveness of antioxidants to prevent the loss of divalent tin in the plating baths. Combinations of antioxidants were also evaluated.

Accelerated testing was conducted to determine the effect various antioxidants have on the formation of insoluble oils and/or gels. During the test, one liter of test solution was maintained at between 30 and 50° C. under stir bar agitation. Stainless steel electrodes were placed under a load of 10 amps. Ethoxylated (EO) and propoxylated (PO) surfactants were combined in water with methane sulfonic acid (MSA), and the antioxidant under evaluation. "EO/PO-butanol" refers to a copolymer of ethylene oxide and propylene oxide having one end terminated with butanol. "EO-bis-phenol" refers to an ethylene oxide polymer having both ends terminated with phenol. The results are in Table 1.

TABLE 1

| Example No. | Acid | Conc. g/l | Surfactant | Conc. g/l | Antioxidant | Conc. g/l | Result |
|---|---|---|---|---|---|---|---|
| Comparative Example 1 | MSA | 50 | EO/PO-butanol | 4 | catechol | 1 | Oils formed |
| Comparative Example 2 | MSA | 50 | EO-bis-phenol | 5 | hydroquinone | 0.5 | Oils formed |
| Example 1 | MSA | 50 | EO/PO-butanol | 4 | [1]dihydroxy benzene sulfonic acid, potassium salt | 1 | NONE |
| Example 2 | MSA | 50 | EO/PO-block copolymer | 1 | [2]sulfosalicylic acid | 0.5 | NONE |

[1]Formula 1, wherein a = 0, b = 2 and Y = $K^+$
[2]Formula 1, wherein R = COOH, a = 1, b = 1, and Y = H As the data in Table 1 clearly shows, the use of a hydroxy benzene sulfonic acid (Examples 1 and 2) prevents the formation of insoluble materials under conditions consistent with use in electroplating baths.

Tests were conducted to simulate high speed plating operations where ambient oxygen is constantly introduced into the bath by pumping and mixing. The procedure involved the preparation of test plating solutions of known divalent tin concentration. Antioxidants were then evaluated at different concentrations to determine how each affected divalent tin loss. During the test, oxygen was bubbled through the test solution at a known rate, while the solution temperature was maintained at 45° C. (+/−5° C.). The results are presented in Table 2 as a percent (%) loss of tin, calculated as the ratio of total divalent tin present after the test, to the total amount of divalent tin present prior to conducting the test described above. In each case, the starting test solution contained 50 g/l tin, 100 g/l MSA (as the free acid), and oxygen was bubbled in at 500 ml/min for 120 hours.

TABLE 2

| Example | Antioxidant | Concentration g/l | % $Sn^{2+}$ Loss |
|---|---|---|---|
| Blank | none | 0 | 9.4 |
| Example 3 | [1]1,4-dihydroxy benzenesulfonic acid, potassium salt | 0.25 | 4.3 |
| Comparative Example 3 | hydroquinone | 0.25 | 5.6 |
| Example 4 | [1]1,4-dihydroxy benzenesulfonic acid, potassium salt | 0.5 | 2.5 |
| Comparative Example 4 | hydroquinone | 0.5 | 3.0 |
| Example 5 | [1]1,4-dihydroxy benzenesulfonic acid, potassium salt | 1.0 | 1.8 |
| Comparative Example 5 | hydroquinone | 1.0 | 3.8 |

[1]Formula 1, wherein a = 0, b = 2, and Y = K+

Use of the disclosed antioxidant, as represented by Examples 3, 4, and 5 clearly demonstrate a significant alleviation of tin oxidation in the samples in relation to the comparative samples. This result translates into a similar alleviation of tin sludge formation during plating operations. In addition, combination of the hydroxybenzene sulfonic acids are also useful herein to reduce the oxidation of divalent tin, as demonstrated by the Examples in Table 3.

The Examples in Table 3 represent test solutions containing 20 g/l tin, 10 g/l iron, and 40 g/l MSA (free acid), under the temperature and oxygen bubbling rates described above. The test was conducted over a 104 hour time period.

TABLE 3

| Example | Antioxidant 1 | Conc. g/l | Antioxidant 2 | Conc. g/l | % $Sn^{2+}$ Loss |
|---|---|---|---|---|---|
| Example 6 | [1]1,4-dihydroxy benzenesulfonic acid, potassium salt | 5.0 | None | 0 | 6.3 |
| Example 7 | [1]1,4-dihydroxy benzenesulfonic acid, potassium salt | 5.0 | [2]sulfosalicylic acid | 0.5 | 4.0 |

[1]Formula 1, wherein a = 0, b = 2, and Y = $K^+$
[2]Formula 1, wherein R = COOH, a = 1, b = 1, and Y = H The results in Table 3 clearly indicate an unanticipated improvement in antioxidant properties when the hydroxybenzene sulfonic acids are combined in a single solution.

What is claimed is:

1. A solution for use in the electroplating of tin and tin alloys comprising: a basis solution comprising an acid, optionally a salt thereof, selected from the group consisting of fluoboric acid, an alkane sulfonic acid, or a combination thereof; divalent tin ions; one or more surfactants with a cloud point higher than 33° C.; and an antioxidant compound at a concentration range of at least 0.1 g/l to less than 1 g/l, the antioxidant compound having a formula:

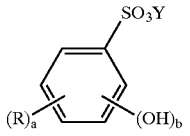

wherein Y is selected from the group consisting of H, alkali metal ions, alkaline earth metal ions, transition metal ions, and ammonium ions, wherein a is 0, 1, 2, or 3, b is 1, 2, 3, 4, or 5, and the sum of a and b is equal to 2, 3, 4, or 5, and R is selected from the group consisting of, halogen, CN, COOY, $C_1$–$C_3$ alky, substituted $C_1$–$C_3$ alkyl, and $C_1$–$C_3$ alkoxy, wherein said alkyl substitutions are selected from the group consisting of straight chain or branched alkoxy, alkenyl, alkynyl, cycloalkyl, cycloalkenyl, acyl, phenyl, halosubstituted phenyl, heteroaryl, halogen, hydroxyl, cyano, or combinations comprising at least one of the foregoing.

2. The solution of claim 1, wherein said alkane sulfonic acid is methane sulfonic acid.

3. The solution of claim 1, further comprising at least one wetting agent, brightener, leveling agent, additional antioxidant comprising a hydroxybenzene sulfonic acid, or combination comprising at least one of the foregoing.

4. The solution of claim 1, further comprising silver, bismuth, copper, lead, or a combination thereof.

5. The solution of claim 1, wherein the antioxidant is 1,4-dihydroxybenzene sulfonic acid or salt thereof.

6. A method of electroplating tin and tin alloys comprising: contacting a substrate with a solution comprising a basis solution comprising an acid, optionally a salt thereof, selected from the group consisting of fluoboric acid, an alkane sulfonic acid, or a combination thereof; divalent tin ions; one or more surfactants with a cloud point higher than 33° C.; and an antioxidant compound in an amount to reduce the oxidation of divalent tin at a concentration range of at least 0.1 g/l to less than 1 g/l, the antioxidant having a formula:

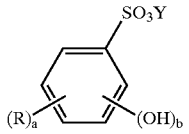

wherein Y is selected from the group consisting of H, alkali metal ions, alkaline earth metal ions, transition metal ions, and ammonium ions, wherein a is 0, 1, 2, or 3, b is 1, 2, 3, 4, or 5, and the sum of a and b is equal to 2, 3, 4, or 5, and each R is independently selected from the group consisting of halogen, CN, COOY, $C_1$–$C_3$ alkyl, substituted $C_1$–$C_3$ alkyl, and $C_1$–$C_3$ alkoxy, wherein said alkyl substitutions are selected from the group consisting of straight chain or branched alkoxy, alkenyl, alkynyl, cycloalkyl, cycloalkenyl, acyl, phenyl, halosubstituted phenyl, heteroaryl, halogen, hydroxyl, cyano, or combinations comprising at least one of the foregoing.

7. The method of claim 6, wherein said alkane sulfonic acid is methane sulfonic acid.

8. The method of claim 6, further comprising at least one wetting agent, brightener, leveling agent, additional antioxidant comprising a hydroxybenzene sulfonic acid, or combination comprising at least one of the foregoing.

9. The method of claim 6, further comprising silver, bismuth, copper, lead, or a combination thereof.

10. The method of claim 6, wherein the antioxidant is 1,4-dihydroxybenzene sulfonic acid or salt thereof.

11. A method for decreasing the oxidation of tin in an electroplating solution containing an alkane sulfonic acid comprising adding a hydroxy benzene sulfonic acid or salt thereof in an amount of at least 0.1 g/l to less than 1 g/l to assist in maintaining the tin ions in the divalent state, the hydroxy benzene sulfonic acid or salt thereof has a formula:

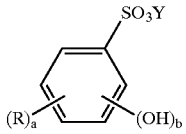

wherein Y is selected from the group consisting of H, alkali metal ions, alkaline earth metal ions, transition metal ions, and ammonium ions, wherein a is 0, 1, 2, or 3, b is 1, 2, 3, 4, or 5, and the sum of a and b is equal to 2, 3, 4, or 5, and each R is independently selected from the group consisting of halogen, CN, COOY, $C_1$–$C_3$ alkyl, substituted $C_1$–$C_3$ alkyl, and $C_1$–$C_3$ alkoxy, wherein said alkyl substitutions are selected from the group consisting of straight chain or branched alkoxy, alkenyl, alkynyl, cycloalkyl, cycloalkenyl, acyl, phenyl, halosubstituted phenyl, heteroaryl, halogen, hydroxyl, cyano, or combinations comprising at least one or the foregoing.

12. The method of claim 11, wherein oxygen content in said electroplating solution is at or near its maximum concentration.

13. The method of claim 11, wherein electroplating is conducted at a temperature at least 15° C.

14. The method of claim 11, wherein the hydroxy benzene sulfonic acid is 1,4-dihydroxybenzene sulfonic acid or salt thereof.

* * * * *